US005425623A

United States Patent [19]

London et al.

[11] Patent Number: 5,425,623

[45] Date of Patent: Jun. 20, 1995

[54] ROD PUMP BEAM POSITION DETERMINATION FROM MOTOR POWER

[75] Inventors: Robert K. London, Bakersfield, Calif.; David G. Loucks, Sugar Land, Tex.

[73] Assignee: Eaton Corporation, Cleveland, Ohio

[21] Appl. No.: 35,464

[22] Filed: Mar. 23, 1993

[51] Int. Cl.[6] ..... F04B 49/06; G05B 1/01

[52] U.S. Cl. ..... 417/18; 417/44.1; 417/44.11; 417/45; 417/63; 318/606

[58] Field of Search ..... 417/18, 44.1, 53, 63, 417/44.11, 45; 318/606, 437, 478, 479, 482; 361/30, 31, 434

[56] References Cited

U.S. PATENT DOCUMENTS

| | | | |
|---|---|---|---|
| 4,220,440 | 9/1980 | Taylor et al. . | |
| 4,370,098 | 1/1983 | McClain et al. | 417/18 |
| 4,473,338 | 9/1984 | Garmong | 417/63 |
| 4,493,613 | 1/1985 | Sommer . | |
| 4,601,640 | 7/1986 | Sommer . | |
| 4,695,779 | 9/1987 | Yates . | |
| 4,767,280 | 8/1988 | Markuson et al. | 417/18 |
| 5,070,725 | 12/1991 | Cox et al. . | |
| 5,167,490 | 12/1992 | McKee et al. | 417/12 |
| 5,284,422 | 2/1994 | Turner et al. | 417/18 |

*Primary Examiner*—Richard A. Bertsch
*Assistant Examiner*—Roland G. McAndrews, Jr.
*Attorney, Agent, or Firm*—Martin J. Moran

[57] ABSTRACT

An electric contactor for the motor of a reciprocating pump such as an oil well walking beam pump, and other cyclic loads, uses the power drawn by the load to determine the phase angle of the pump without the need for a separate phase signalling sensor. The contactor couples the electric pump motor to a power line, and has a power sensor and peak detector. The power sensor can be responsive to RMS AC power or simply to current amplitude and polarity. The motor passes through a minimum power at the extreme top and bottom of a pump stroke, and the phase position at the top of the stroke is preferably detected by sensing for the power reversal that occurs as the momentum of the pump causes regeneration by the motor. The contactor can have overcurrent and/or undervoltage protection features, can include contacts for rearranging the motor windings to vary pump operation, and can report the phase to a pump control and monitoring system, whereby process variables are assessed as a function of phase.

5 Claims, 3 Drawing Sheets

ROD PUMP BEAM POSITION DETERMINATION FROM MOTOR POWER

BACKGROUND OF THE INVENTION

1. Field of the Invention

The invention relates to the field of controls and monitors for oil well rod pumps and similar cyclic loads, and in particular concerns a method and apparatus for determining indirectly the beam position of a rod pump by monitoring variations in loading of the pump motor. By indirectly identifying the phase position of the pump cycle in this manner, a number of monitoring and control functions are enabled, substantially reducing the need to instrument the well and/or the pump.

2. Prior Art

Oil well walking beam pumps extract fluid from a downhole pump chamber by repeatedly raising and lowering a series of steel rods coupling the downhole pump and the surface beam pumper assembly. The repetitive raising and lowering of the steel rods causes a piston in the downhole pump assembly to pull the well fluids to the surface.

The surface beam pumper assembly typically includes a rocking beam with one end coupled to a pump motor by a crank assembly. The crank assembly has a counterweight intended to balance the loading of the motor by offsetting at least part of the weight of the pump connecting rods which are cantilevered on the opposite end of the rocking beam. Nevertheless, as the rods to the downhole pump are raised and lowered, the loading of the motor passes through a cycle during which potential energy is stored as the pump rods are lifted, and released as the pump rods are lowered.

The motor is typically an electric motor that is geared down to accommodate the relatively low frequency of the pump stroke. A three phase motor is typical. Motor and circuit protection contactor devices typically are provided for breaking the motor circuit in the event of a short circuit or motor overload. Additionally, a controller that is responsive to conditions in the well may be coupled to the contactor devices, for example to operate the pump intermittently at a rate that can be supported by the geological formation. The controller or the contactor device itself may include means for measuring the current in the motor circuit and/or the line voltage by analog or digital circuits, as a part of the circuit protection function, as well as to vary the operation of the pump to suit conditions at the best efficiency.

It is known to provide a contactor for an oil well with relay contacts that rearrange the line couplings of a three phase motor when current loading conditions indicate that the pump is operating inefficiently, for example as disclosed in U.S. Pat. No. 4,220,440—Taylor et al. U.S. Pat. No. 4,695,779—Yates discloses a similar controller that includes a processor and a number of timers that switch between operational modes upon the occurrence of distinct stall conditions.

A processor with a range of flow and energy consumption sensors for assessing well operation is disclosed in U.S. Pat. No. 4,767,280—Markuson, and a processor that integrates additional factors such as the proportions of oil and water in the recovered fluid is disclosed in U.S. Pat. No. 5,070,725—Cox et al.

Although the invention is described herein primarily with reference to a walking beam pump, it is also possible to apply the concepts of a walking beam pump to other forms of cyclic loads. U.S. Pat. Nos. 4,601,640 and 4,493,613, both to Sommer, for example, disclose a compact pump arrangement that reciprocates a piston but does not employ a beam. Instead, a reversing motor manipulates the piston via a cable. These, and the foregoing U.S. Patent disclosures are hereby incorporated by reference, for their teachings of well motor control and sensing arrangements.

Wells are frequently instrumented for purposes of assessing operational parameters. The fluid flow rate produced by the well is an advantageous parameter to measure, and can be measured using flow rate sensors at any point along the conduits through which the fluid is pumped. The fluid pressures produced in the well by the pump can also be monitored, and used to develop additional information, such as the rate at which the geological formation is refilling the pump, and other aspects of well performance. One means for sensing well fluid pressure indirectly is to sense tension and compression of the moving pump structures, for example using strain gauges mounted on such structures or load cells coupled between them.

There are a number of aspects of well and/or pump performance that are pertinent to issues of efficiency, maintenance, capacity, switching between operational modes and the like. The object for the well is of course to supply the maximum fluid possible, and preferably to maximize the percentage of the fluid that is oil rather than water or mud while minimizing the power consumption of the pump. However, optimizing pump operation requires that the operation of the pump be varied to suit conditions. A monitoring system and controller can be provided to sense conditions and to adjust operational parameters such as the frequency of cyclic operation, the manner in which power is coupled to the motor windings and so forth.

The amount of useful work that a fluid transport device performs is the product of the mass rate of fluid flow and the pressure differential or elevation head. The total head borne by the pump includes static and dynamic factors such as the discharge head and the suction head maintained, a velocity head, frictional resistance, etc. The variations in a number of these factors, especially fluid pressure and fluid flow, is cyclic due to the cyclic operation of the pump. It is therefore necessary to assess fluid pressure and flow information as a function of the point at which such data is sampled in the periodic cycle of the pump. The monitoring and control system of the pump thus requires the input of information on the present phase angle of the pump.

The phase angle of the pump can be measured by more or less sophisticated means. For example, a limit switch can be mounted for repetitive operation by contact with the pump beam, and used to trigger sampling of process data at the same point during every cycle, or between counted cycles. A shaft angle encoder can be mounted to produce pulses with angular displacement of the beam or of the motor crank, etc., which allows measurements to be taken at defined points in the cycle. These devices require proper setup and maintenance, and can suffer from mechanical failure. Thus the known arrangements are expensive both initially and with continuing maintenance and use.

It would be advantageous to provide a device that can determine information needed for assessing or controlling pump operation using a minimum of components. The present invention is arranged to develop such information indirectly from variation in the loading of the pump motor, and in particular determines a reference phase angle in the pump cycle from the point of minimum motor power that occurs at the top dead center of the pump stroke.

SUMMARY OF THE INVENTION

It is an object of the invention to assess operational parameters of a cyclic load such as a well pump from the electrical loading of a motor operating the pump.

It is also an object of the invention to determine the phase angle of a reciprocating well pump by detecting at least one peak in the power dissipated by the well pump motor.

It is a further object of the invention to couple a motor protection contactor circuit or preferably an accessory for a protective circuit breaker arrangement, for a cyclic load, producing an output signal that is analyzed for indicating passage through at least one phase angle of operation of the cyclic load.

These and other objects are accomplished by an electric contactor for the motor of a reciprocating pump such as an oil well walking beam pump, and other cyclic loads. The device uses the power drawn by the load to determine the phase angle of the pump without the need for a separate phase signalling sensor. The contactor couples the electric pump motor to a power line, and has a power encoding sensor and a peak detector. The power sensor can be responsive to RMS AC power or can develop a power signal (or an approximation thereof) by sensing the level and polarity of current. The motor passes through a minimum power level at the extreme top and bottom of a pump stroke, where the polarity may reverse due to regeneration from the motor. The phase position at the top of the stroke thus can be detected by sensing for the power reversal that occurs as the momentum of the pump causes regeneration by the motor. The contactor or protective circuit breaker can have overcurrent and/or undervoltage protection features, can include contacts for rearranging the motor windings to vary pump operation, and can report the phase to a pump control and monitoring system, whereby process variables are assessed as a function of phase. The invention simply requires the use of a watt sensor and processor for analyzing power consumption levels, and a plurality of pumps can be monitored in this manner using one processor collecting power data via multiplexed data links to the respective power consumption sensors.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
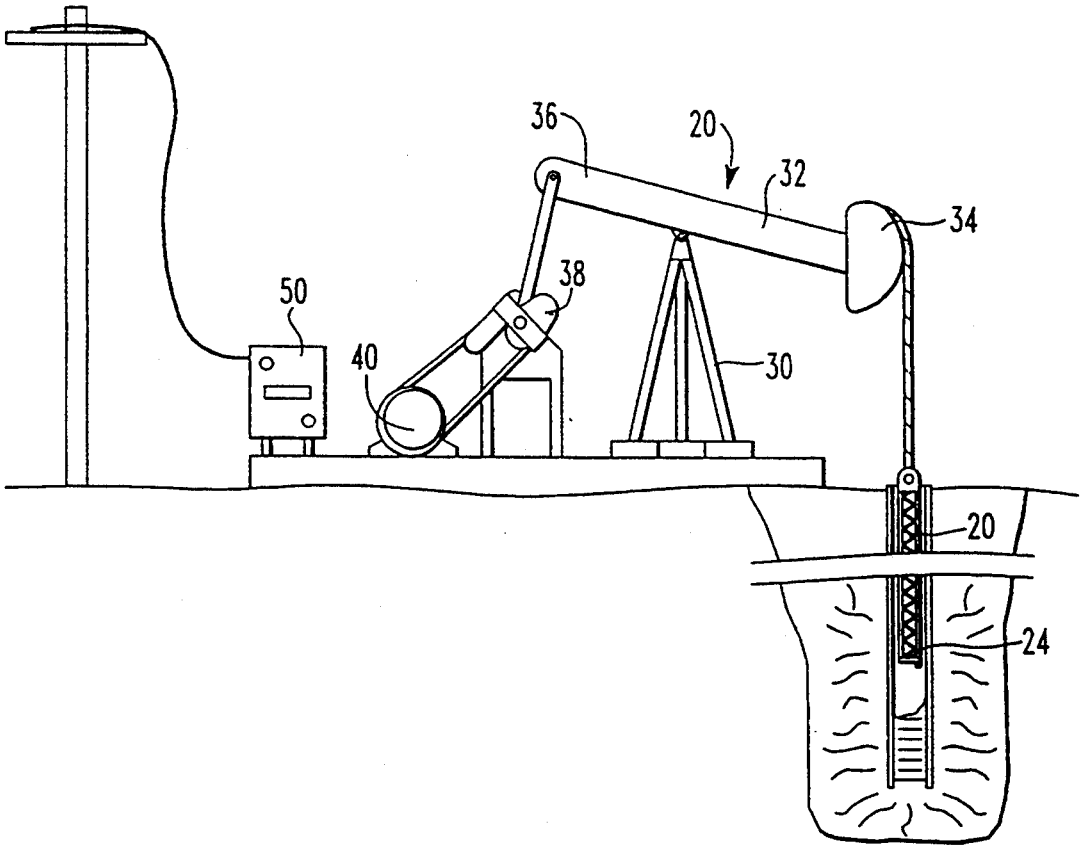
FIG. 1 is an elevation view showing a cyclically operated pump arrangement according to the invention.

As shown in FIG. 1, a well pump arrangement 20 according to the invention has a series of connecting rods 22 coupling a downhole piston/chamber pump 24 to a surface walking beam pumper 30. The surface pumper 30 has a rocking beam 32 with one end 34 connected to the downhole rods 22 and an opposite end 36 connected by eccentric linkages to a rotating counterweight member 38. The counterweight member 38 is rotated by an electric motor 40, being coupled by a belt or chain drive, and/or coupled to the motor 40 through a gear train. As the motor 40 turns the counterweight member 38, the beam 32 is rocked to raise and lower the downhole rods 22, operating the pump 24 in a periodic manner at a relatively low frequency.

The motor 40 can be a three phase multi-winding AC motor, for example operable at 440 VAC, and developing 10 to 125 horsepower, depending on the capacity and depth of the pump 24. As shown schematically in FIG. 2, the pump arrangement 20 can be provided with a contactor 44 operable to activate and deactivate pumping, to change the winding configuration between Y, ΔY and Δ, as disclosed in U.S. Pat. Nos. 4,220,440—Taylor and 4,695,779—Yates, and/or can be coupled to an overload/underload controller including a processor and timing means as in U.S. Pat. No. 4,767,280 Markuson et al, each of which patents is incorporated herein by reference.

According to the invention, a controller 50 of this general type is provided with information regarding the phase angle of the pump arrangement 20 in its cycle. This information is obtained from monitoring the periodic nature of the electrical power consumption of the pump motor 40. With the phase of the pump arrangement 20 thereby available to the controller 50, it becomes possible to calculate the values of additional process variables, either with the aid of sensors coupled to the pump arrangement 20 or entirely from the electric power applied to the pump motor 40. As a result, well and pump performance monitoring data is obtained and decisions can be made for controlling operation of the pump 20, with no or minimal reliance on mechanical switches or sensors for detecting tension, compression, flow rate, pressure and other similar variables that might otherwise be used to determine mark the passage of the pump arrangement 20 through its successive pumping cycles.

Preferably, the invention is embodied as an improved form of pump controller of the type known as a "pump panel" in the industry, but is provided with additional computational capabilities in order to effect the objects of the invention. The smart pump panel of the invention can be based on an electromechanical contactor—motor starter such as the Advantage TM three phase contactor marketed by Westinghouse Electric Corporation, preferably including the Energy Sentinel TM module that is mounted on the circuit breaker and includes current and voltage sensing circuits, a filter and multiplying arrangement, and an analog to digital converter for producing a digital output representing the instantaneous energy consumption of a load coupled thereto, such as motor 40. The Energy Sentinel TM is also operable to sense the polarity of the power flow. If the motor is operated in a regenerative mode and power is supplied to the power grid from the motor during a portion of the pump stroke, the Energy Sentinel output so indicates. In this regard, it is understood that power or energy "consumption," as used herein, should be construed to include generation or negative consumption.

The digital output data is coupled to a programmable controller forming the processor 56 of the controller 50, and is read, for example, every 150 to 200 mS to collect instantaneous power consumption data. The programmable controller is coupled to input/output modules whereby the sample data and the data generated by computation from the sample data and/or from additional sensor inputs can be communicated to recording or communication devices. Preferably, the output data developed by the controller 50 is communicated by radio modem, line drivers, telephone modem or the like to a remote location. However it is also possible to use the data only locally, in connection with a pump-off type controller (for determining when and for how long the pump should run) that has the additional capabilities discussed herein. It is also possible to couple a number of power consumption sensors at different wells to one controller via a shared communication technique such as time or frequency division multiplexing.

Figure 2:
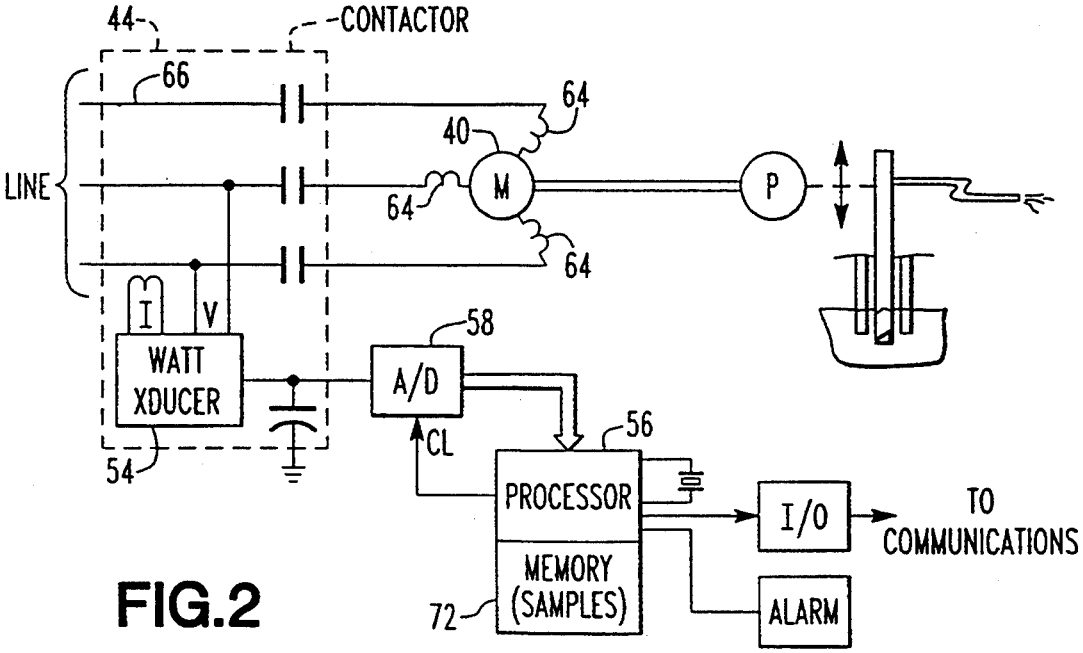
FIG. 2 is a schematic block diagram showing the functional elements of the invention.

Referring to FIG. 2, the controller 50 is coupled to a transducer 54 operable to sense the instantaneous electric power level drawn from the power line 66 by the electric motor 40 operating the well pump 24, or coupled into the power line 66 with regeneration. In the embodiment shown, the controller 50 comprises a digital processor 56 and the transducer 54 comprises a watt transducer that produces a voltage output proportional to the instantaneous power level. The voltage output is sampled using an analog to digital converter 58 clocked periodically by the controller 50, at a frequency substantially higher than the frequency of cyclic pump operation, e.g., several times per second. The watt transducer 54 averages the AC power consumption of the motor 40 over the power line frequency, but produces a substantially sinusoidal output signal at the frequency of the pump 24. This occurs because as the pump 24 raises and lowers the downhole pump rods 22 during each pump cycle, the motor 40 is cyclically loaded. The pump arrangement 20 passes through a power stroke, and then with continuing momentum passes through a regenerative stroke, each pump cycle including the power and regenerative portions.

Motor loading is at its minimum during the times that the beam 32 is at the top and bottom of its stroke. An absolute minimum occurs immediately preceding the downstroke portion of the cycle. The power at this point typically reverses and becomes negative as the momentum of the pump 24 and connecting rod structures 22 cause regeneration of the motor 40.

The watt transducer 54 effectively measures the RMS current in the motor windings 64 and the RMS voltage across the power line 66, and multiplies these values to produce the output presented to the analog to digital converter 58 representing the instantaneous power level. It is also possible to approximate the instantaneous power level by measuring only for current, thus assuming that the voltage level remains at the nominal voltage of the power grid. However, the current measurement must be sensitive to the polarity of the current flow, as provided for example in the Westinghouse Energy Sentinel TM device. Reliance on a measurement of current is less accurate than taking current and voltage into account, due to the reactive nature of the electrical load, particularly as the motor 40 is cyclically loaded and regenerated.

Figure 3:
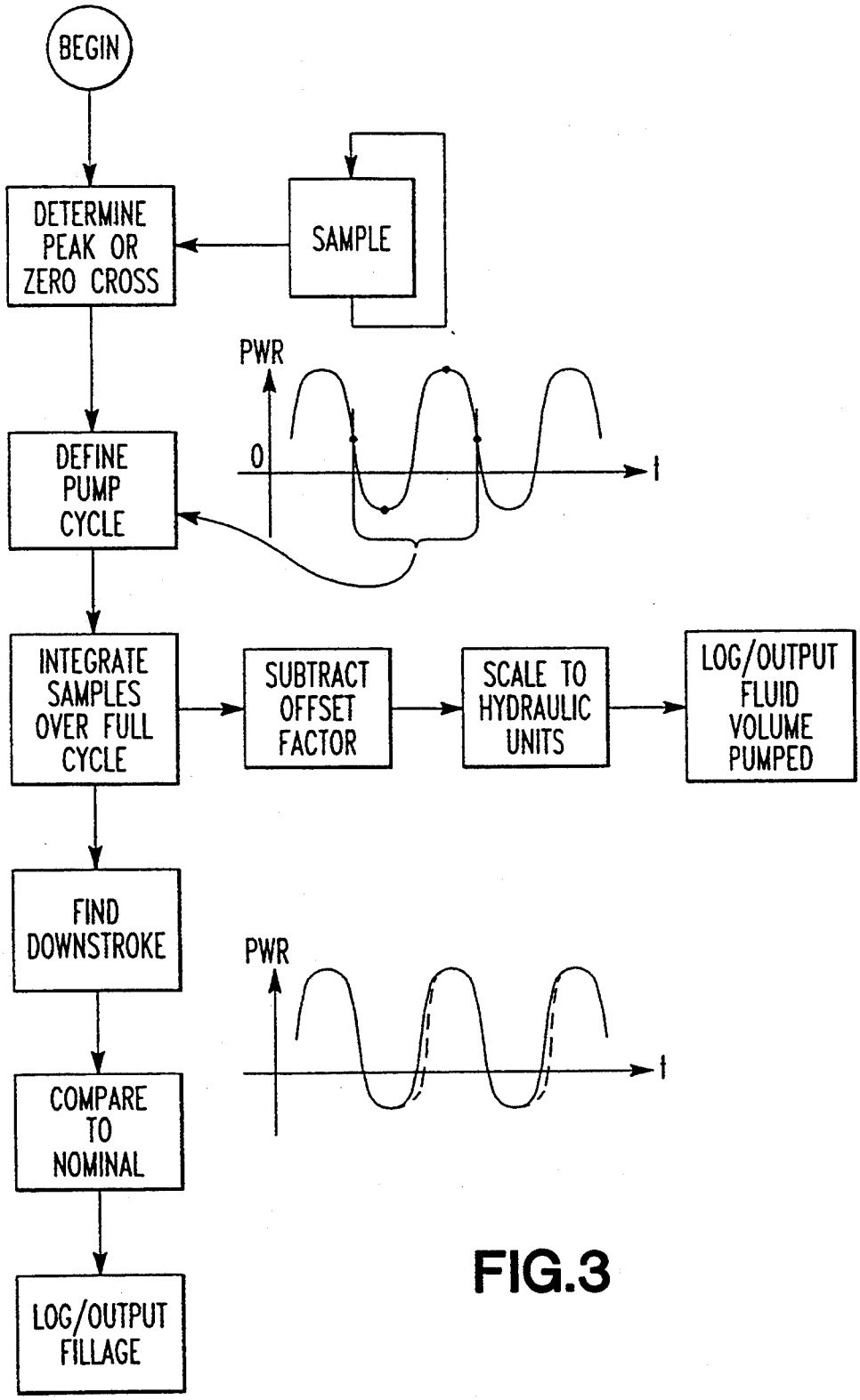
FIG. 3 is a flowchart illustrating the measurement and processing steps according to the invention.

As shown by the flowchart diagram of FIG. 3, the processor 56 of the controller 50 stores the data representing the sampled power level and processes the data to determine the times at which successive minimums occur. The timing of these minimums defines the operational pumping frequency and by interpolation it is also possible to estimate the phase position of the pump at any time.

The controller 50 may be programmed to effect various measurements and computations from input data, such as integrating the detected instantaneous power level by adding the sampled data values over a complete pump cycle to measure the hydraulic power exerted and the frictional losses of the pump arrangement 20 and motor 40 as a whole. Such a procedure is helpful to indirectly measure the fluid flow from the pump 24 and to monitor maintenance needs as shown by variations in frictional loading. As another alternative, the controller 20 may analyze the power consumption at different points in the pump cycle. For example, the controller may be arranged to monitor for changes in the specific area of the downstroke of the pump, for assessing the extent to which the pump chamber is being filled. A further possibility is to analyze specifically for variations in the difference between the power consumption during the suction phase and the pressure phase of the pump, for assessing the total head developed by the pump with respect to the geological formation.

The integrated power level over the pump cycle is stored or logged, to enable analysis and comparison of the power levels. For short term measurements of intra-phase variations or portions of a cycle, only one cycle of data needs to be stored. Preferably, however, either the sample data or the results of computations on the sample data, are stored over a number of cycles. The controller 50 can be arranged to store the data in a local memory 72 and/or to record the data for longer term storage on a tape or disk, to print reports or graphic plots, or to report the data via remote communication, e.g., over a modem.

The hydraulic power exerted and the frictional loss both vary over time and for successive pump cycles. However, frictional losses tend to vary very slowly in comparison to the variation of the hydraulic power or useful work exerted by the pump 24. The power variances during a cycle and between cycles over a relatively short period (e.g., less than one day) are primarily due to changes in hydraulic power. By monitoring the power variances as a function of pump phase angle, the power variances are correlated to process parameters that are helpful for monitoring and controlling the pump, i.e., to make operational and maintenance decisions. Contactor 44, operated by outputs from the controller 50 can activate and deactivate the pump 24, change the configuration of pump motor windings 64, operate alarms or signals for maintenance, and otherwise manage the pump arrangement 20 for efficient operation, relying substantially on the information available to the controller 50 by monitoring the electric power consumption of the pump motor 40.

Figure 4:
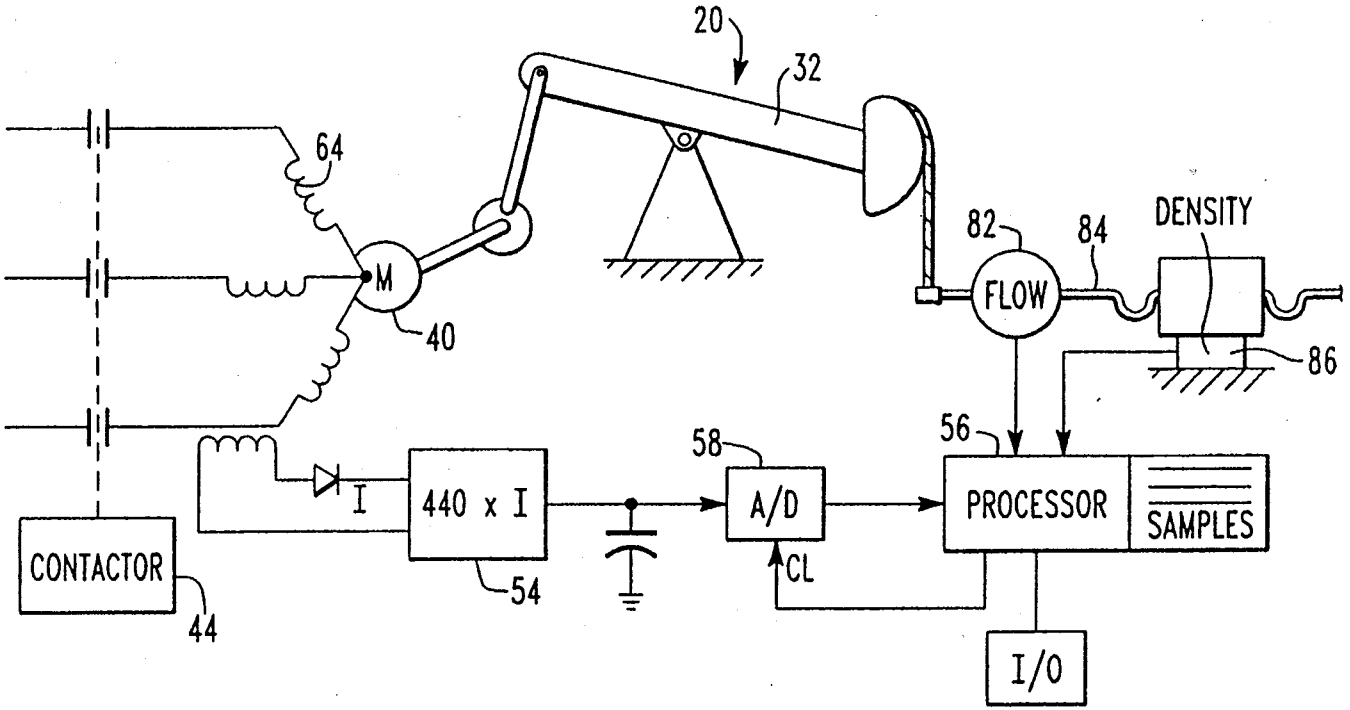
FIG. 4 is a schematic block diagram showing an alternative arrangement wherein the instantaneous power consumption is determined from the RMS current level and polarity.

FIG. 4 illustrates an alternative embodiment wherein the power level is sensed from the instantaneous current level. FIG. 4 also illustrates the manner in which collection of phase data from analyzing the variations in power consumption during pumping cycles can be used with sensors, for example a flow sensor 82 and a fluid density sensor 86, each mounted along an output conduit 84 of the pump 24 and coupled to the processor 56 for collecting data by direct measurement. The sensors 82, 86 can be accessed by the controller to collect a measurement at a specific phase angle during each cycle, or can be clocked at regular intervals to collect measurements throughout the cycle, which the processor 56 can analyze for phase related variations.

The output of the flow sensor 82 can be integrated to assess the total production of the pump. However, the fluid output of an oil well pump typically includes oil, water and mud. Density sensor 86 is operable to measure the density of the pumped fluid, for determining the probable proportions of the three materials and processing flow data and the like more accurately.

The invention thus provides an apparatus for coupling an electric power line to a cyclic load, with power sensing means operable to develop a signal representing the amplitude and polarity of instantaneous power drawn by the load or regenerated by the load, which as noted above can be approximated by current flow measurements, and a peak detector coupled to the signal, developing an output signal representing a phase position of the cyclic load as determined by variation of the instantaneous current over an operational period of the cyclic load.

Peak detection can be a function of a controller coupled to the signal. The controller can operate switching means coupling the line to the load, to make and break a connection between the line and the load upon occurrence of overcurrent conditions and/or undervoltage conditions. The controller can be coupled directly to the power consumption sensor, or one controller can service the power consumption sensors of a number of pumps over a multiplexing arrangement.

A preferred power consumption sensor is the Westinghouse Energy Sentinel TM device, which is a modular element that attaches to a circuit breaker. This device is responsive to the current amplitude and polarity and to the voltage across the line, effectively multiplying instantaneous current and instantaneous voltage levels to produce the output. The controller then samples the output to determine the phase position of the pump.

The invention is useful as a part of a control system operable to vary operation of the pump or other cyclic load. The control system is coupled to the peak detector and can be coupled to at least one sensor operable to measure an operational parameter of the cyclic load (in addition to the information available from monitoring the power consumption). The control system assesses the operational parameter at a phase angle defined by the phase position determined by the peak detector. The output of sensors that measure such operational parameters can be used to calibrate the control system such that the data developed from power consumption data is rendered more accurate, e.g., by adjusting offset or scaling factors applied to the power data to estimate parameters from the power consumption data.

The peak detector (e.g., the controller) can be arranged to detect a power reversal between the line and the load due to regenerative operation of the load during the operational period. Where the cyclic load is an oil well pump, such a power reversal typically occurs on every cycle as the reciprocable piston and chamber arrangement of the pump are operated under power of an electric motor and a mechanical linkage between the motor, piston and chamber for reciprocating the pump over a cyclic period.

The invention determines the phase angle of the well pump from a peak or zero crossing in the power dissipated by the well pump motor, enabling various additional measurements. Furthermore, such measurements are made available via relatively simple and inexpensive additions to the motor protection contactor circuit or circuit breaker arrangement.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A pump arrangement, comprising in combination:

a reciprocable piston and chamber;

an electric motor and a mechanical linkage between the motor, piston and chamber for reciprocating the pump over a cyclic period through a 360° span of phase;

a contractor coupling the electric motor to a power line, including power sensing means operable to develop a signal representing an instantaneous power drawn by the motor and a peak detector coupled to the signal, the peak detector developing an output signal representing a phase position of the pump in the 360° where a variation of the instantaneous power occurs repetitively during successive cyclic periods of reciprocation of the piston and chamber; and a control system comprising means to vary operation of the cyclic load, and wherein the control system is coupled to the peak detector and to at least one sensor operable to measure an operational parameter of the cyclic load, the control system further comprising means for assessing the operational parameter at a phase angle defined by the phase position determined by the peak detector.

2. The pump arrangement according to claim 1, wherein the variation of the instantaneous power that occurs repetitively includes a power reversal between the line and the load due to regenerative operation of the load at a particular phase position during the operational period and said operational parameter is measured at a phase angle related to the phase position at which the regenerative operation occurs.

3. An apparatus for coupling an electric power line to a cyclic load, the load having a continuous variation in power consumption while operating, due to periodic operation of the load at an operational frequency and over a 360° span of phase, comprising:

power sensing means producing a signal representing an instantaneous power drawn by the load, the signal of the power sensing means representing variations in said instantaneous power within the 360° span of phase;

a peak detector coupled to the signal, the peak detector developing an output signal representing a phase position of the cyclic load as determined by variation of the instantaneous power over an operational period of the cyclic load;

a controller, the signal of the power sensing means being coupled to said controller; switching means responsive to the controller for coupling the line to the load, the switching means making and breaking a connection between the line and the load upon occurrence of at least one of overcurrent conditions and undervoltage conditions; and a control system having means to vary operation of the cyclic load, and wherein the control system is coupled to the peak detector and to at least one sensor operable to measure an operational parameter of the cyclic load, the control system further comprising means for assessing the operational parameter of at least one phase angle in the 360° span referenced to the phase position determined by the peak detector.

4. The apparatus according to claim 3, wherein the peak detector detects a power reversal between the line and the load due to regenerative operation of the load during the operational period, said phase position of the cyclic load occuring at the power reversal.

5. The apparatus according to claim 4, wherein the cyclic load is a reciprocating oil well pump and the 360° span of phase represents one full reciprocation of the oil well pump.

* * * * *